US009908037B2

(12) United States Patent
Muse et al.

(10) Patent No.: US 9,908,037 B2
(45) Date of Patent: Mar. 6, 2018

(54) ELECTRONIC GAMING DIE

(71) Applicant: Board of Regents, The University of Texas System, Austin, TX (US)

(72) Inventors: Danny W. Muse, El Paso, TX (US); Ryan Wicker, El Paso, TX (US); Eric MacDonald, El Paso, TX (US); Rodolfo Salas, El Paso, TX (US); Francisco Medina, El Paso, TX (US)

( * ) Notice: Subject to any disclaimer, the term of this patent is extended or adjusted under 35 U.S.C. 154(b) by 626 days.

(21) Appl. No.: 14/327,663

(22) Filed: Jul. 10, 2014

(65) Prior Publication Data

US 2015/0014923 A1 Jan. 15, 2015

Related U.S. Application Data

(60) Provisional application No. 61/845,334, filed on Jul. 11, 2013.

(51) Int. Cl.
*A63F 9/04* (2006.01)
*A63F 9/24* (2006.01)

(52) U.S. Cl.
CPC ..... *A63F 9/0415* (2013.01); *A63F 9/0468* (2013.01); *A63F 2009/0497* (2013.01); *A63F 2009/2447* (2013.01); *A63F 2009/2454* (2013.01); *Y10T 29/49146* (2015.01)

(58) Field of Classification Search
USPC ..... 273/146, 276, 156, 157
See application file for complete search history.

(56) References Cited

U.S. PATENT DOCUMENTS

| | | | |
|---|---|---|---|
| D269,984 | S | 8/1983 | McKechnie |
| 4,641,840 | A | 2/1987 | Larson |
| 4,863,789 | A | 9/1989 | Arai |
| 5,096,532 | A | 3/1992 | Neuwirth et al. |
| 5,121,329 | A | 6/1992 | Crump |

(Continued)

FOREIGN PATENT DOCUMENTS

| | | | |
|---|---|---|---|
| JP | 2007018467 | U | 3/1995 |
| JP | 2002270422 | A | 9/2002 |

(Continued)

OTHER PUBLICATIONS

Ahn, et al. "Anisotropic material properties of fused deposition modeling ABS" Rapid Prototyping Journal (2002) 8 (4) pp. 248-257.

(Continued)

*Primary Examiner* — Dmitry Suhol
*Assistant Examiner* — Brandon Gray
(74) *Attorney, Agent, or Firm* — Yee & Associates, P.C.

(57) ABSTRACT

An electronic gaming die includes an enclosure, a flexible substrate, a number of light emitting diodes, a sensor, a processor and a battery. The enclosure has N sides where N is equal to or greater than 4. The flexible substrate folds into N sides and fits into an interior of the enclosure, wherein each side has an inner face, an outer face and is assigned an integer from 1 to N. The light emitting diodes are disposed on the outer face of each side of the flexible substrate, wherein the number of light emitting diodes equals the integer assigned to the side of the flexible substrate. The sensor, processor and battery are disposed on one of the inner faces of the flexible substrate.

57 Claims, 16 Drawing Sheets

(56) References Cited

U.S. PATENT DOCUMENTS

| | | | | |
|---|---|---|---|---|
| 5,656,905 | A | 8/1997 | Tsai | |
| 5,694,680 | A | 12/1997 | Yamada et al. | |
| 6,457,626 | B1 | 10/2002 | Sheehan et al. | |
| 6,626,364 | B2 | 9/2003 | Taban | |
| 6,698,089 | B2 | 3/2004 | Finn et al. | |
| 7,017,905 | B2 | 3/2006 | Lindsey | |
| 7,334,791 | B2 | 2/2008 | Lindsey et al. | |
| 7,419,630 | B2 | 9/2008 | Palmer et al. | |
| 7,555,357 | B2 | 6/2009 | Holzwarth | |
| 7,556,490 | B2 | 7/2009 | Wicker et al. | |
| 7,646,029 | B2 * | 1/2010 | Mueller | F21K 9/00 257/13 |
| 7,658,603 | B2 | 2/2010 | Medina et al. | |
| 7,959,847 | B2 | 6/2011 | Wicker et al. | |
| 8,123,224 | B2 | 2/2012 | Deruyter | |
| 8,252,223 | B2 | 8/2012 | Medina et al. | |
| 2004/0151978 | A1 | 8/2004 | Huang | |
| 2005/0164778 | A1 | 7/2005 | Cooney | |
| 2006/0119542 | A1 * | 6/2006 | Ho | G09F 9/33 345/34 |
| 2007/0187137 | A1 | 8/2007 | Isebo | |
| 2008/0224293 | A1 | 9/2008 | Hin | |
| 2008/0268942 | A1 * | 10/2008 | DeRuyter | A63F 9/0413 463/22 |
| 2008/0314626 | A1 | 12/2008 | Moore | |
| 2009/0020919 | A1 | 1/2009 | Marsac | |
| 2009/0102296 | A1 * | 4/2009 | Greene | H01Q 1/248 307/149 |
| 2009/0210101 | A1 | 8/2009 | Hawkins et al. | |
| 2010/0055895 | A1 | 3/2010 | Zafiropoulo et al. | |
| 2010/0058580 | A1 | 3/2010 | Yasdani | |
| 2010/0291304 | A1 | 11/2010 | Becker | |
| 2011/0121476 | A1 | 5/2011 | Batchelder et al. | |
| 2013/0170171 | A1 | 7/2013 | Wicker et al. | |
| 2013/0180450 | A1 | 7/2013 | Hamilton et al. | |

FOREIGN PATENT DOCUMENTS

| | | | |
|---|---|---|---|
| JP | 2002532912 | A | 10/2002 |
| JP | 2010219364 | A | 9/2010 |
| KR | 1020110088644 | A | 8/2011 |
| KR | 1020110134701 | A | 12/2011 |
| WO | 2009093248 | A1 | 7/2009 |
| WO | 2013103600 | A4 | 7/2013 |

OTHER PUBLICATIONS

ASTM Standard F2792-12a. (2012). "Standard Terminology for Additive Manufacturing Technologies," ASTM International, West Conshohocken, PA.

Espalin, et al. "Fused deposition modeling of polymethylmethacrylate for use in patient-specific reconstructive surgery" Rapid Prototyping Journal, vol. 16, Issue 3, 2010.

International Search Report and Written Opinion of KIPO for PCT/US2012/072100 dated Apr. 26, 2013, 9 pages.

International Search Report and Written Opinion of KIPO for PCT/US2014/028206, dated Jun. 27, 2014, 10 pages.

International Search Report and Written Opinion of KIPO for PCT/US2014/028106, dated Jun. 27, 2014, 12 pages.

Lopes, Amit J. "Hybrid manufacturing: Integrating stereolithography and direct print technologies," Ph.D. Dissertation, The University of Texas at El Paso, 2010, 128 pages.

Lopes, et al. "Integrating stereolithography and direct print technologies for 3D structural electronics fabrication" Rapid Prototyping Journal, vol. 18, Issue 2, 2012, pp. 129-143.

Miettinen, et al. "Inkjet printed System-in-Package design and manufacturing" Microelectronics Journal, vol. 39, Issue 12, Dec. 2008, pp. 1740-1750.

Olivas, et al. "Structural electronics through additive manufacturing and micro-dispensing" !IMAPS National Conference, Oct. 2010.

Roberson, et al. "Ohmic curing of printed silver conductive traces." Journal of Electronic Materials (2012): 1-14.

Roberson, et al. "Microstructural and Process Characterization of Conductive Traces Printed from Ag Particulate Inks," Materials, vol. 4, Issue 6, 2011, pp. 963-979.

Zein, et al. "Fused Deposition Modeling of Novel Scaffold Architectures for Tissue Engineering Applications"Biomaterials, vol. 23, Issue 4, 2002, pp. 1169-1185.

Lopes, et al. "Expanding rapid prototyping for electronic systems integration of arbitrary form" 17th Annual Solid Freeform Fabrication Symposium, University of Texas at Austin, Aug. 14-16, 2006.

* cited by examiner

ELECTRONIC GAMING DIE

CROSS-REFERENCE TO RELATED APPLICATIONS

This application claims priority to U.S. Provisional Application Ser. No. 61/845,334, filed Jul. 11, 2013, the entire contents of which are incorporated herein by reference.

STATEMENT OF FEDERALLY FUNDED RESEARCH

Not Applicable.

REFERENCE TO A SEQUENCE LISTING

Not Applicable.

TECHNICAL FIELD OF THE INVENTION

Embodiments relate in general to the manufacture of electronic, electromagnetic and electromechanical components and devices, and more particularly to an electronic gaming die.

BACKGROUND OF THE INVENTION

Without limiting the scope of the disclosed embodiments, the background is described in connection with methods for manufacturing 3D objects and structures, more specifically 3D structural electronic, electromagnetic and electromechanical components and devices.

The recent introduction of MEMs-based accelerometers has enabled many new gaming and commercial electronics applications like enhanced features in cell phones and the Nintendo Wiimote. The introduction of the accelerometry into gaming dice has only recently been made possible by this new technology. Although a LED-lit 20 sided dice has been sold on websites like Thinkgeek, the electronics involved are basic and only involve one side (the 20) with a pressure sensor.

SUMMARY OF THE INVENTION

The disclosed embodiments can make gaming dice more visually stunning and makes the dice outcome more obvious—an important feature in a color and lighting-rich environment such as a casino. The disclosed embodiments can be manufactured using 3D printing of dielectric structures with conductive traces serving as electrical interconnects.

More specifically, the present invention provides an electronic gaming die that includes an enclosure, a flexible substrate, a number of light emitting diodes, a sensor, a processor and a battery. The enclosure has N sides where N is equal to or greater than 4. The flexible substrate folds in a manner that leaves it with N sides and fits into an interior of the enclosure, wherein each side has an inner face, an outer face and is assigned an integer from 1 to N. The light emitting diodes are disposed on the outer face of each side of the flexible substrate, wherein the number of light emitting diodes equals the integer assigned to the side of the flexible substrate. The sensor is disposed on one of the inner faces of the flexible substrate. The processor is disposed on one of the inner faces of the flexible substrate and communicably coupled to the sensor and the one or more light emitting diodes. The battery is disposed on one of the inner faces of the flexible substrate and electrically connected to the one or more light emitting diodes, the sensor and the processor.

In addition, the disclosed embodiments can provide a method for manufacturing an electronic gaming die by first fabricating a flexible substrate. The flexible substrate folds into N sides where N is equal to or greater than 4, wherein each side has an inner face, an outer face and is assigned an integer from 1 to N. A number of light emitting diodes disposed on the outer face of each side of the flexible substrate such that the number of light emitting diodes equals the integer assigned to the side of the flexible substrate. A sensor can be disposed on one of the inner faces of the flexible substrate. A processor can be disposed on one of the inner faces of the flexible substrate and communicably coupled to the sensor and the one or more light emitting diodes. A battery can be disposed on one of the inner faces of the flexible substrate and electrically connected to the one or more light emitting diodes, the sensor and the processor. Next, an enclosure having N sides is provided and the flexible substrate can be folded such that the folded flexible substrate fits into an interior of the enclosure. The folded flexible substrate can be inserted into the interior of the enclosure and the enclosure is sealed. This method can be implemented as a computer program embodied on a non-transitory computer readable medium wherein the steps are preformed using one or more code segments.

BRIEF DESCRIPTION OF THE DRAWINGS

For a more complete understanding of the features and advantages of the present invention, reference is now made to the detailed description of the invention along with the accompanying figures and in which.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention. For example, the present invention is described with respect to the design of a six sided gaming die that includes a microprocessor and accelerometer in order to detect a roll, measure the direction of gravity and illuminate light emitting diodes (LED) on the upward face. The present invention, however, is not limited to a six sided gaming die or the specific design examples described herein.

To facilitate the understanding of this invention, a number of terms are defined below. Terms defined herein have meanings as commonly understood by a person of ordinary skill in the areas relevant to the present invention. Terms such as "a", "an," and "the" are not intended to refer to only a singular entity, but include the general class of which a specific example may be used for illustration. The terminology herein is used to describe specific embodiments of the invention, but their usage does not delimit the invention, except as outlined in the claims.

Figure 1A:
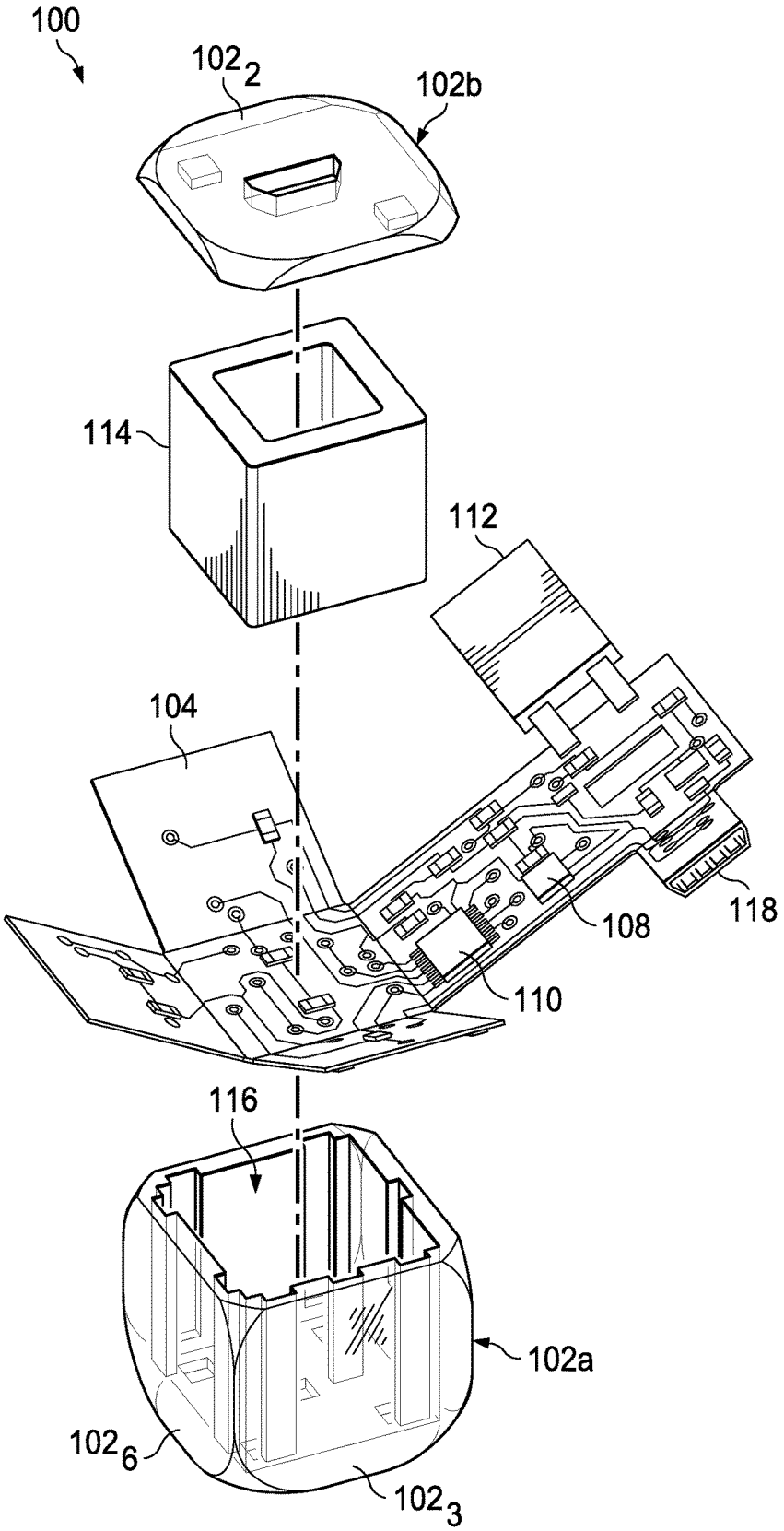
FIGS. 1A and 1B are images showing an exploded view of an electronic gaming die in accordance with one embodiment of the present invention.
Figure 1B:
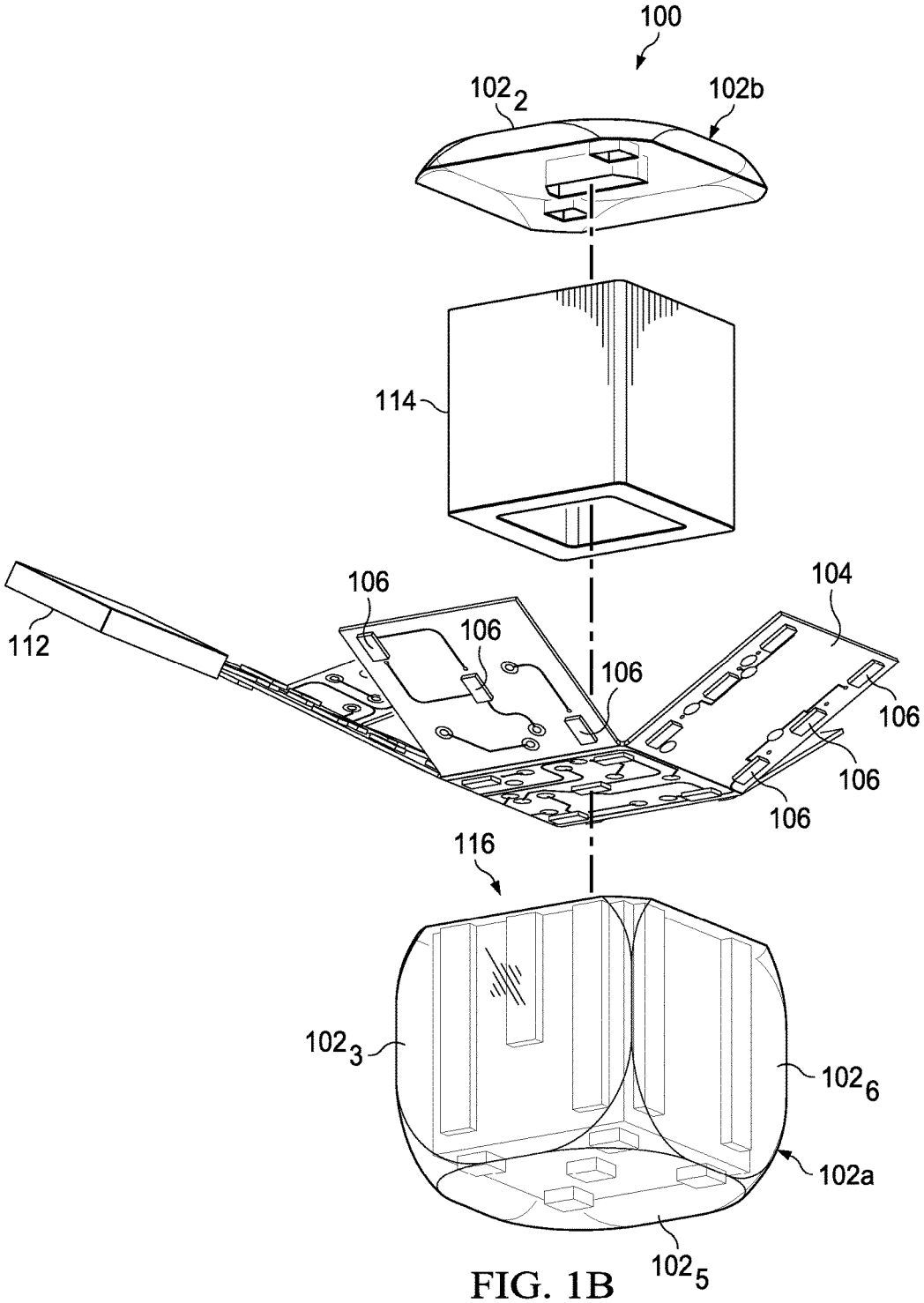

Now referring to FIGS. 1A and 1B, images showing an exploded view of an electronic gaming die 100 in accordance with one embodiment of the present invention are shown. The electronic gaming die 100 includes an enclosure 102, a flexible substrate 104, light emitting diodes 106, a sensor 108, a processor 110, a battery 112 and an insert 114. The enclosure 102 (made up of main enclosure 102*a* and enclosure lid or cap 102*b*) has N sides ($\mathbf{102}_1$ to $\mathbf{102}_N$) where N is equal to or greater than 4. In the example shown, N=6. In other embodiments of the present invention, N can equal 4, 6, 8, 10, 20 or more. The enclosure 102 can be transparent or semi-transparent. Likewise, a portion of the enclosure 102 proximate to the one or more light emitting diodes 106 can be transparent or semi-transparent, and the remainder of the enclosure 102 can be opaque.

Figure 2:
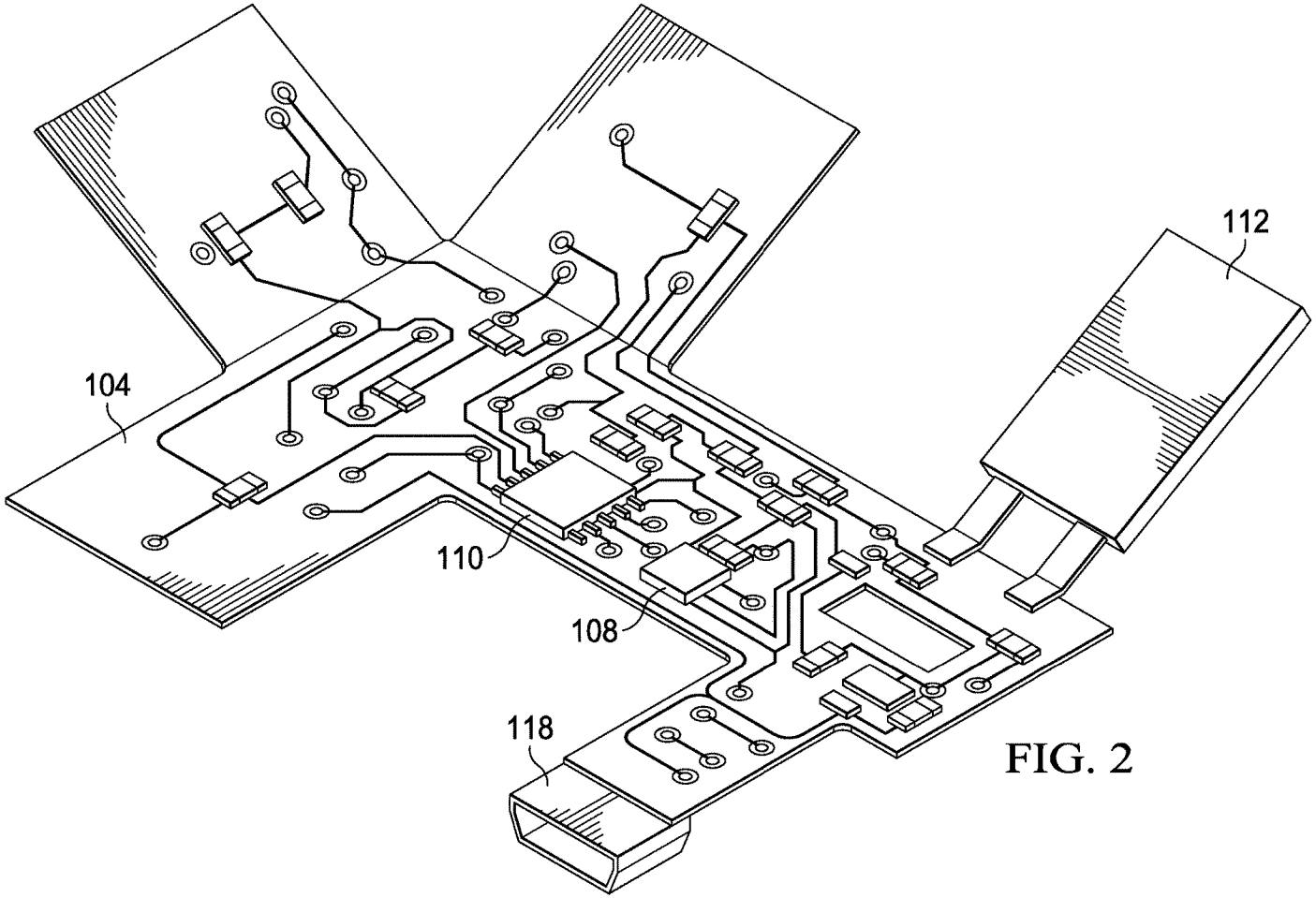
FIG. 2 is an image showing the folds of the inner sides of a flexible substrate for an electronic gaming die in accordance with one embodiment of the present invention.
Figure 4A:
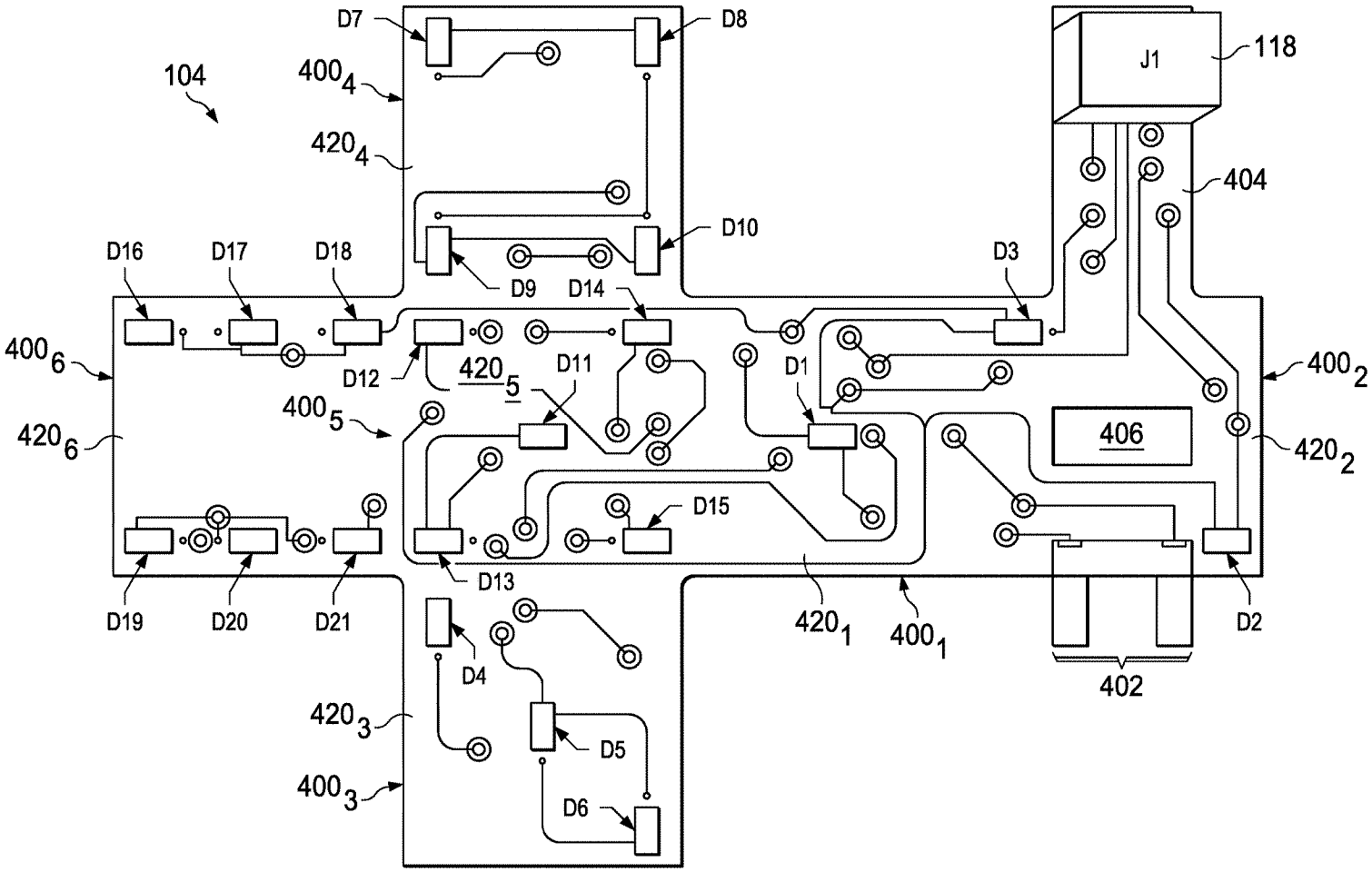
FIGS. 4A and 4B are images showing the outer sides and inner sides, respectively, of a flexible substrate for an electronic gaming die in accordance with one embodiment of the present invention.

The flexible substrate 104 folds into N sides (see also FIG. 2) and fits into an interior 116 of the enclosure 102. Each side of the flexible substrate 104 has an inner face (FIG. 1A; see also FIG. 4B) and an outer face (FIG. 1B; see also FIG. 4A). The sensor 108 (preferably a three-axis accelerometer) is disposed on one of the inner faces of the flexible substrate 104. The processor 110 is disposed on one of the inner faces of the flexible substrate 104 and is communicably coupled to the sensor 108 and the one or more light emitting diodes 106. The sensor 108 and processor 110 detect a roll, measure a direction of gravity and illuminate the light emitting diode(s) 106 on the upward face. The processor 108 can operate the light emitting diodes 106 is various modes, which can be user configurable. For example, the light emitting diodes 106 can stay lit for a specified period of time, or flash to show which side of the enclosure 102 is up when the electronic gaming die 100 stops rolling, etc. The battery 112 is disposed on one of the inner faces of the flexible substrate 104 and electrically connected to the one or more light emitting diodes 106, the sensor 108 and the processor 110. The battery 112 can be replaceable or rechargeable. For example, an interface 118 (e.g., mini USB-A, mini USB-b, micro USB-A, micro USB-b, etc.) can be electrically connected to the battery 112 and accessible from an exterior of the enclosure 102 to recharge the battery 112. Alternatively, a wireless battery recharging circuit (not shown) can be electrically connected to the battery 112 and disposed on one of the inner faces of the flexible substrate 104. Likewise, one or more photovoltaic cells (not shown) can be electrically connected to the battery 112 and disposed on or within the enclosure 102 or the flexible substrate 104.

The electronic gaming die 100 may automatically enter a sleep mode whenever one or more sleep conditions occur and remain in the sleep mode until one or more wakeup conditions occur. For example, the one or more sleep conditions may include the sensor 108 not detecting motion for a specified period of time, the sensor 108 detecting a specified sleep sequence, the electronic gaming die 100 remains stationary for a specified period of time, etc. The sleep sequence can be orienting the dice for at least two seconds with the "one" side held up, followed by the "two", followed by the "three" and so on, or any other desired sequence. The low power mode may involve a staged power down of the electronic gaming die 100 (e.g., component-by-component starting with deactivating the light emitting diodes 106). The one or more wakeup conditions may include the sensor 108 detecting motion after the sleep mode has been entered or a specific time period thereafter, the sensor 108 detecting a specified wakeup sequence, the electronic gaming die 100 being "rolled" after the sleep mode has been entered or a specified time period thereafter, etc.

Figure 3A:
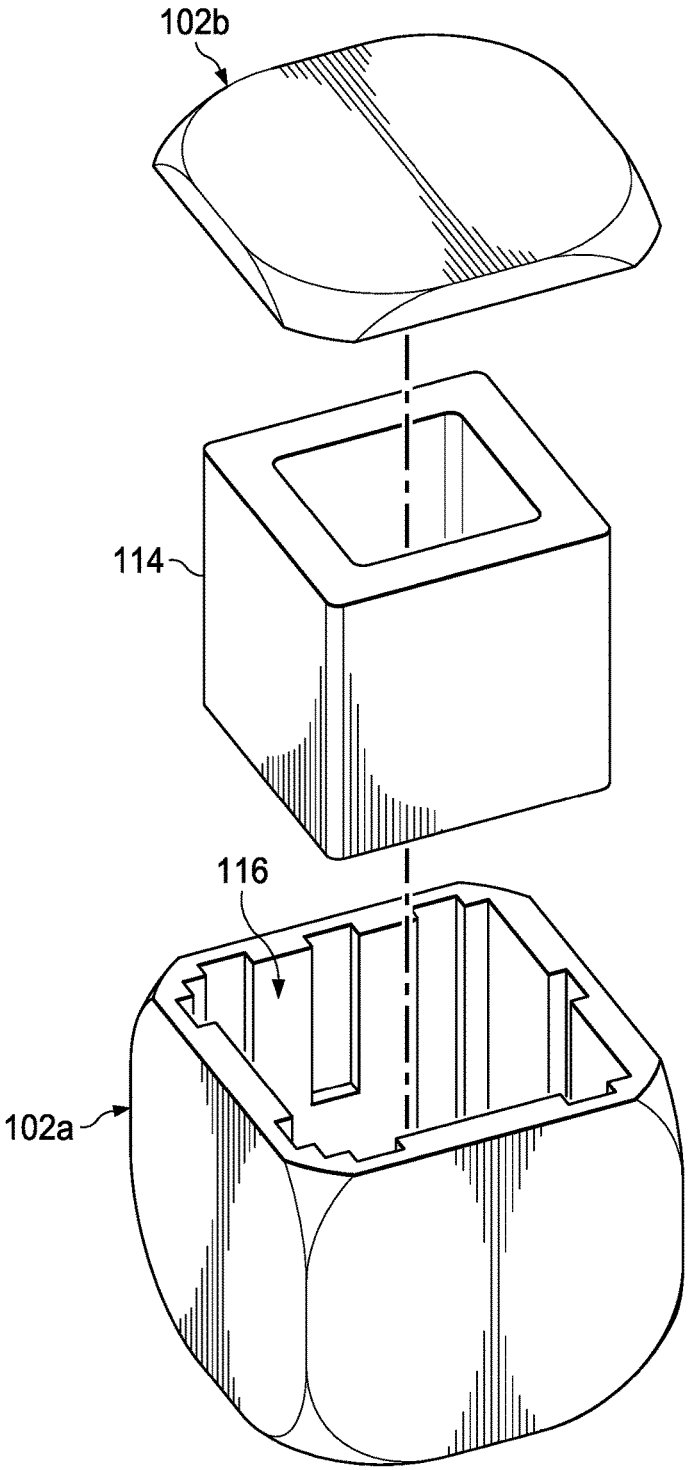
FIGS. 3A and 3B are exploded drawings of an enclosure and insert for an electronic gaming die in accordance with one embodiment of the present invention.
Figure 3B:
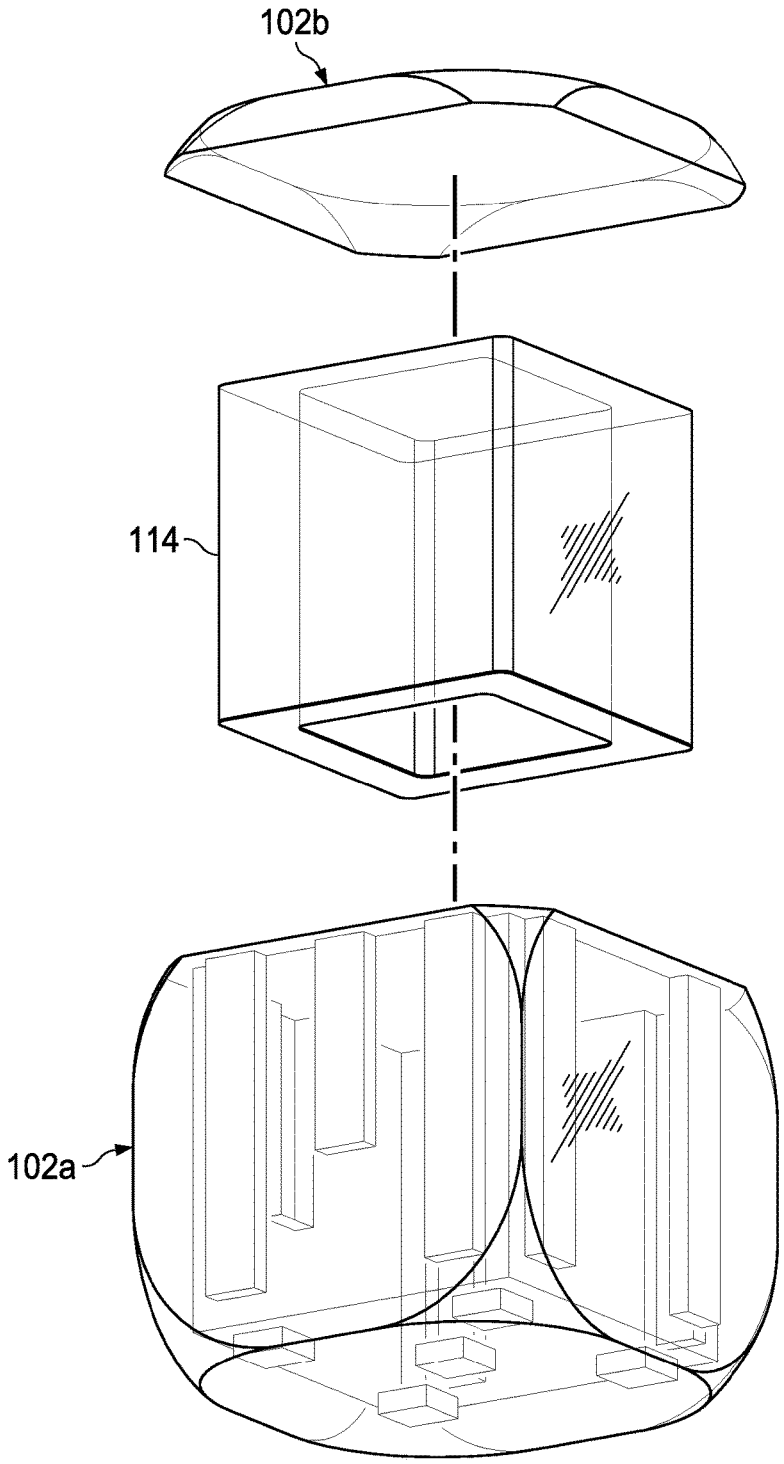

Now also referring to FIGS. 3A and 3B, exploded drawings of an enclosure 102 and insert 114 for an electronic gaming die 100 in accordance with one embodiment of the present invention are shown. The insert 114 is disposed within an interior 116 of the folded flexible substrate 104 and sized to maintain a position of the flexible substrate 104 against the interior of the enclosure 102. The enclosure 102 may include slots, channels, cavities, recesses, depressions or other inner surface features to accommodate the light emitting diodes 106 or other components disposed on the outer faces of the flexible substrate 104. For example, the enclosure lid or cap 102*a* in FIGS. 1A and 1B includes an opening to accommodate the interface 118.

Alternatively, the lid or cap 102*a* can be removable in order to change out the battery 112. Note that that one or more inscriptions can be engraved on the enclosure 102. The insert 114 can be rigid, semi-rigid, or hollow. Alternatively, the insert 114 can be eliminated and replace by: (1) an adhesive or one or more connectors that attach one or more edges of the sides of the flexible substrate 104 together to maintain a shape of the folded flexible substrate 104; (2) an expanding foam sealant disposed within an interior of the folded flexible substrate 104; or (3) any other suitable method of maintain a shape of the folded flexible substrate 104. Moreover, the insert 114 can be weighted to balance a weight of the die 100, or unbalance the die 100 to favor a specified orientation (i.e., a loaded die or "cheating" die).

Figure 4B:
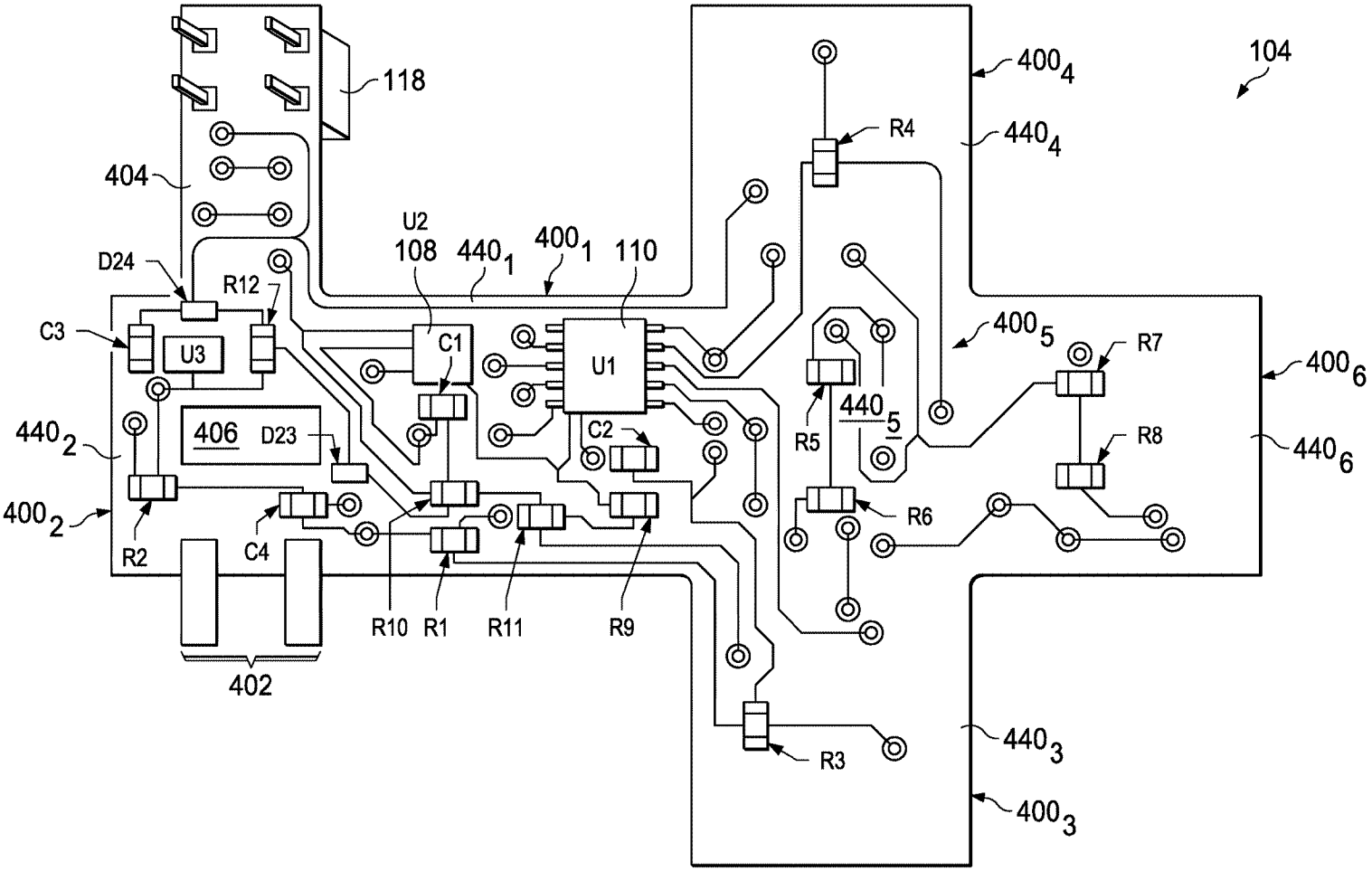

Referring now to FIGS. 4A and 4B, images showing the outer faces ($\mathbf{420}_1$ to $\mathbf{420}_N$) and inner faces ($\mathbf{440}_1$ to $\mathbf{440}_N$), respectively, of a flexible substrate 104 for an electronic gaming die 100 in accordance with one embodiment of the present invention are shown. This embodiment and the embodiment shown in FIGS. 9A and 9B have components on both the outer faces 400 and the inner faces 420 of the flexible substrate 104. In contrast, the embodiment shown in FIGS. 10A and 10B only has components on the inner faces 420 of the flexible substrate 104, which substantially reduces the manufacturing cost.

Each side 400 of the flexible substrate 104 is assigned an integer from 1 to N (e.g., $\mathbf{400}_1$ to $\mathbf{400}_6$). A number of light emitting diodes 106 are disposed on the outer face 420 of each side 400 of the flexible substrate 104. The number of light emitting diodes 106 equals the integer assigned to the side 400 of the flexible substrate 104 and the corresponding side of the enclosure 102. For example and as shown in FIG. 4A, the first outer face $\mathbf{420}_1$ of the first side $\mathbf{400}_1$ of the flexible substrate 104 has one light emitting diode D1, the second outer face $\mathbf{420}_2$ of the second side $\mathbf{400}_2$ of the flexible substrate 104 has two light emitting diodes D2-D3, the third outer face $\mathbf{420}_3$ of the third side $\mathbf{400}_3$ of the flexible substrate 104 has three light emitting diodes D4-D6, the fourth outer face $\mathbf{420}_4$ of the fourth side $\mathbf{400}_4$ of the flexible substrate 104 has four light emitting diodes D7-D10, the fifth outer face $\mathbf{420}_5$ of the fifth side $\mathbf{400}_5$ of the flexible substrate 104 has five light emitting diodes D11-D15, and the sixth outer face $\mathbf{420}_6$ of the sixth side $\mathbf{400}_6$ of the flexible substrate 104 has six light emitting diodes D16-D21. Each light emitting diode D1-D21 represents a pip of the electronic gaming die 100. Alternatively, the number of light emitting diodes 106 can be greater than the number of the integer assigned to the side 400 of the flexible substrate 104 such that the number of light emitting diodes 106 are arranged to display a numeric character corresponding to the integer.

As shown in FIG. 4B, the sensor 108 and processor 110 are disposed on one of the inner faces (e.g., $\mathbf{440}_1$) of the flexible substrate 104. Two leads 402 are used to connect the circuit to the battery 112 (not shown). An additional side 404 is used to mount the interface 118 (e.g., mini USB-A, mini USB-b, micro USB-A, micro USB-b, etc.) and orient the interface 118 to be accessible via the opening 406 in side $\mathbf{400}_2$. As will be appreciated by those skilled in the art, the circuit includes various capacitors Cx, resistors Rx, electrical traces (conductors) and other desired components. In addition, one or more inner faces 420 or one or more outer faces 440 of the flexible substrate 104 can be coated with an ultraviolet photocurable polymer to further protect the various components and the flexible substrate 104.

The flexible substrate 104 can be fabricated using traditional flexible circuit board methodologies or fabricated using a 3D printing process wherein the electrical conductors that connect the various components are printed conductive traces that can traverse one or more folds of the flexible substrate 104. An example of such a 3D printing g system is described in U.S. patent application Ser. No. 13/343,651, which is incorporated by reference in its entirety. The three-dimensional printing device creates one or more layers of a three-dimensional substrate by depositing a substrate material in a layer-by-layer fashion. The three-dimensional printing device can be a fused deposition modeling machine, a selective laser sintering machine or another suitable device.

Figure 5:
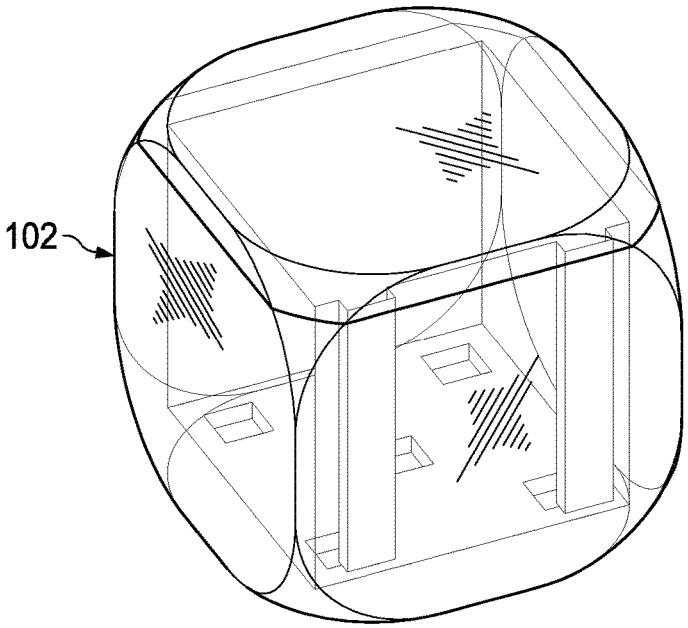
FIG. 5 is an image of an enclosure for an electronic gaming die in accordance with one embodiment of the present invention.
Figure 8:
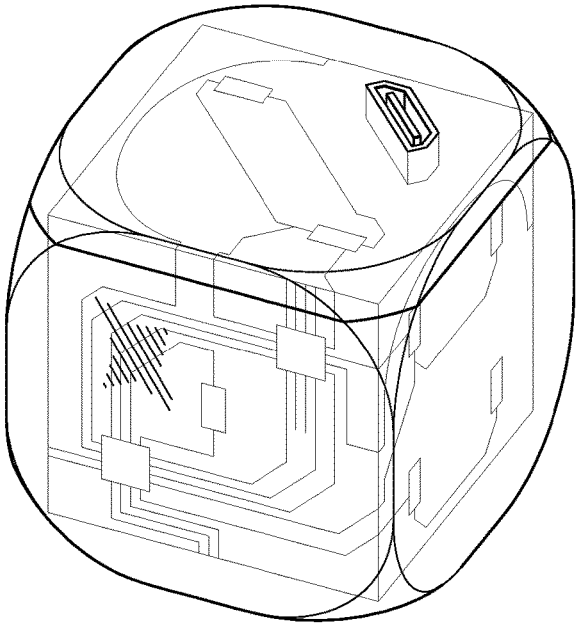
FIG. 8 is an image of an electronic gaming die in accordance with another embodiment of the present invention fabricated with 3D Printing.
Figure 6A:
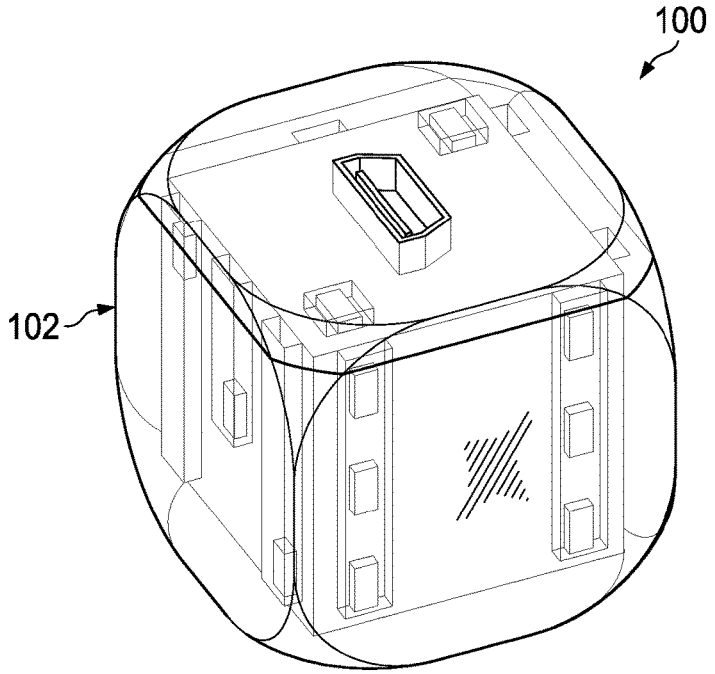
FIGS. 6A and 6B are images showing an assembled electronic gaming die with a transparent enclosure in accordance with another embodiment of the present invention.
Figure 6B:
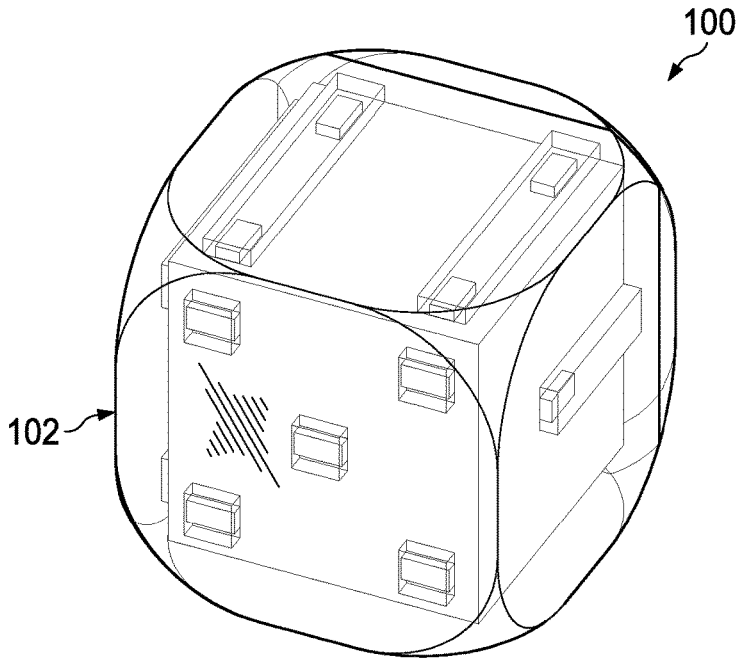
Figure 7:
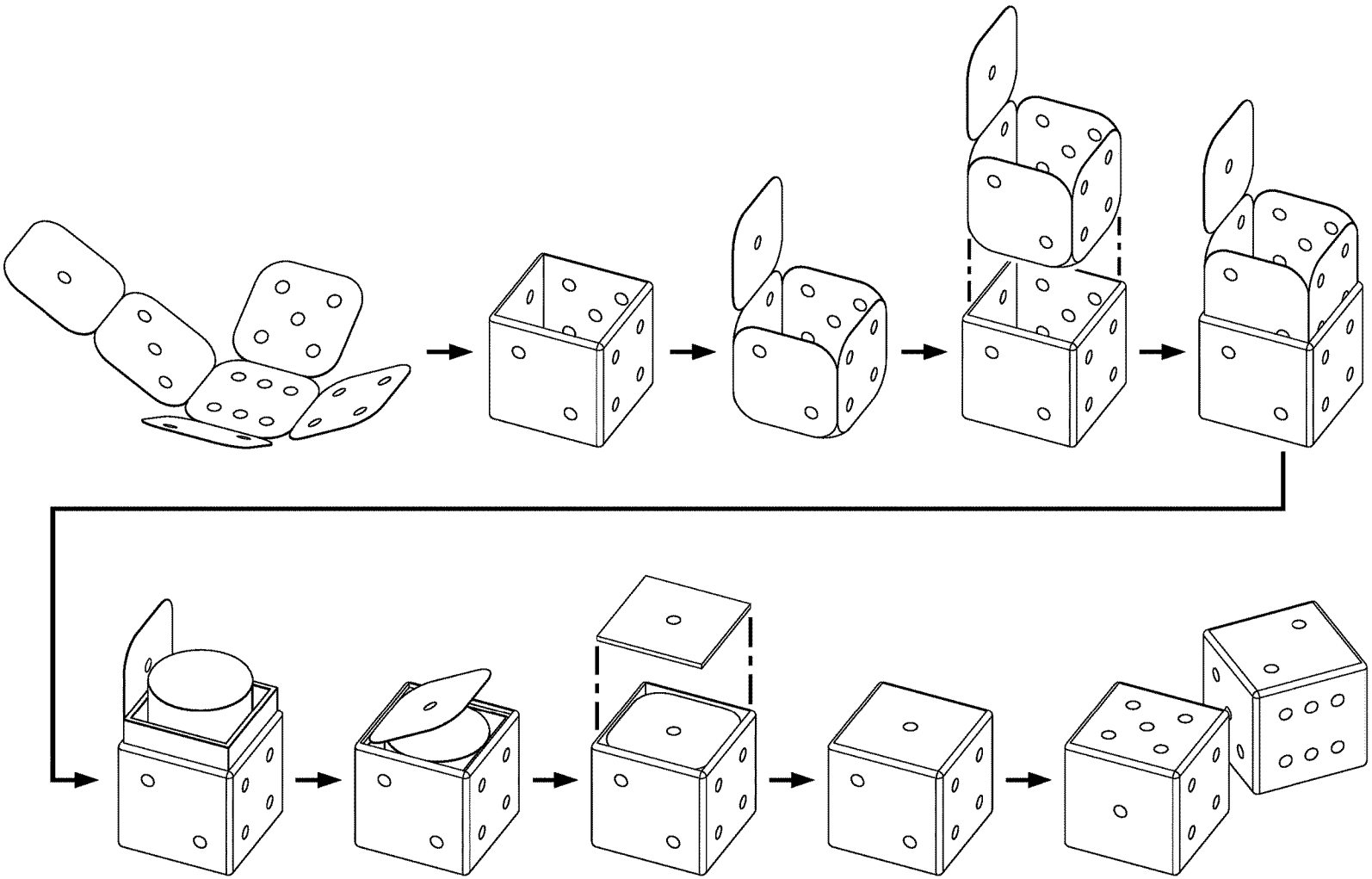
FIG. 7 is a series of images showing the assembly process for an electronic gaming die in accordance with one embodiment of the present invention.

FIG. 5 illustrates an image of an enclosure 102 for an electronic gaming die 100 in accordance with one embodiment FIGS. 6A and 6B illustrate images of an assembled electronic gaming die 100 with a transparent enclosure 102 in accordance with another example embodiment. FIG. 7 illustrates a series of images showing the assembly process for an electronic gaming die 100 in accordance with an example embodiment. FIG. 8 illustrates an image of an electronic gaming die 100 in accordance with yet another example embodiment. As shown in FIG. 8, the electronic gaming die 100 can also be fabricated with 3D Printing technology in conjunction with micro-dispensing of conductive inks serving as electrical interconnect. 3D Printing of the structure can allow for rapid prototyping not just of the structure but also for the electronic functionality as demonstrated in FIG. 8. 3D Printing can thus allow for faster evaluation of form and function at an unprecedented level.

Figure 9A:
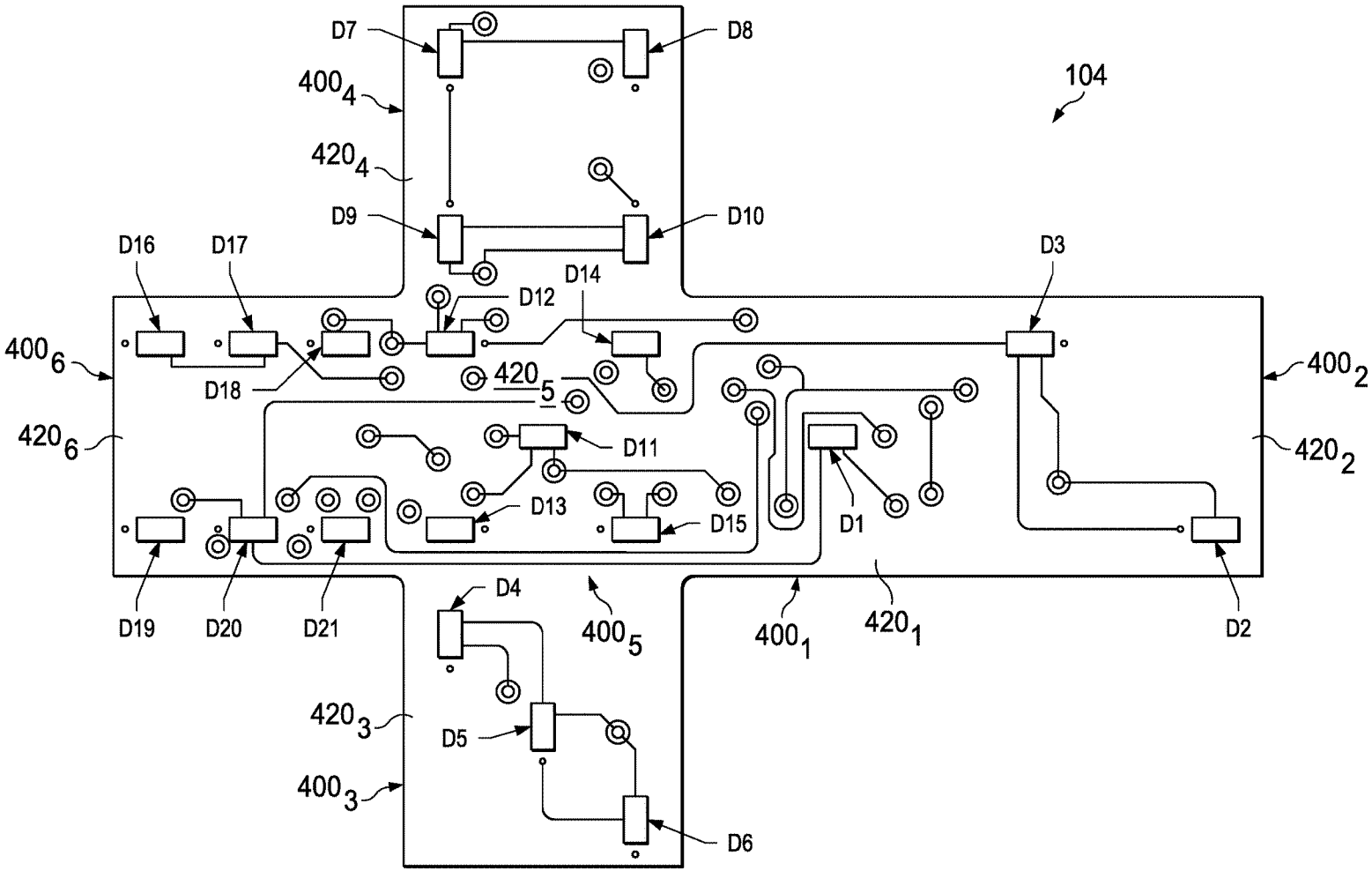
FIGS. 9A and 9B are images showing the outer sides and inner sides, respectively, of a flexible substrate for an electronic gaming die in accordance with another embodiment of the present invention.
Figure 9B:
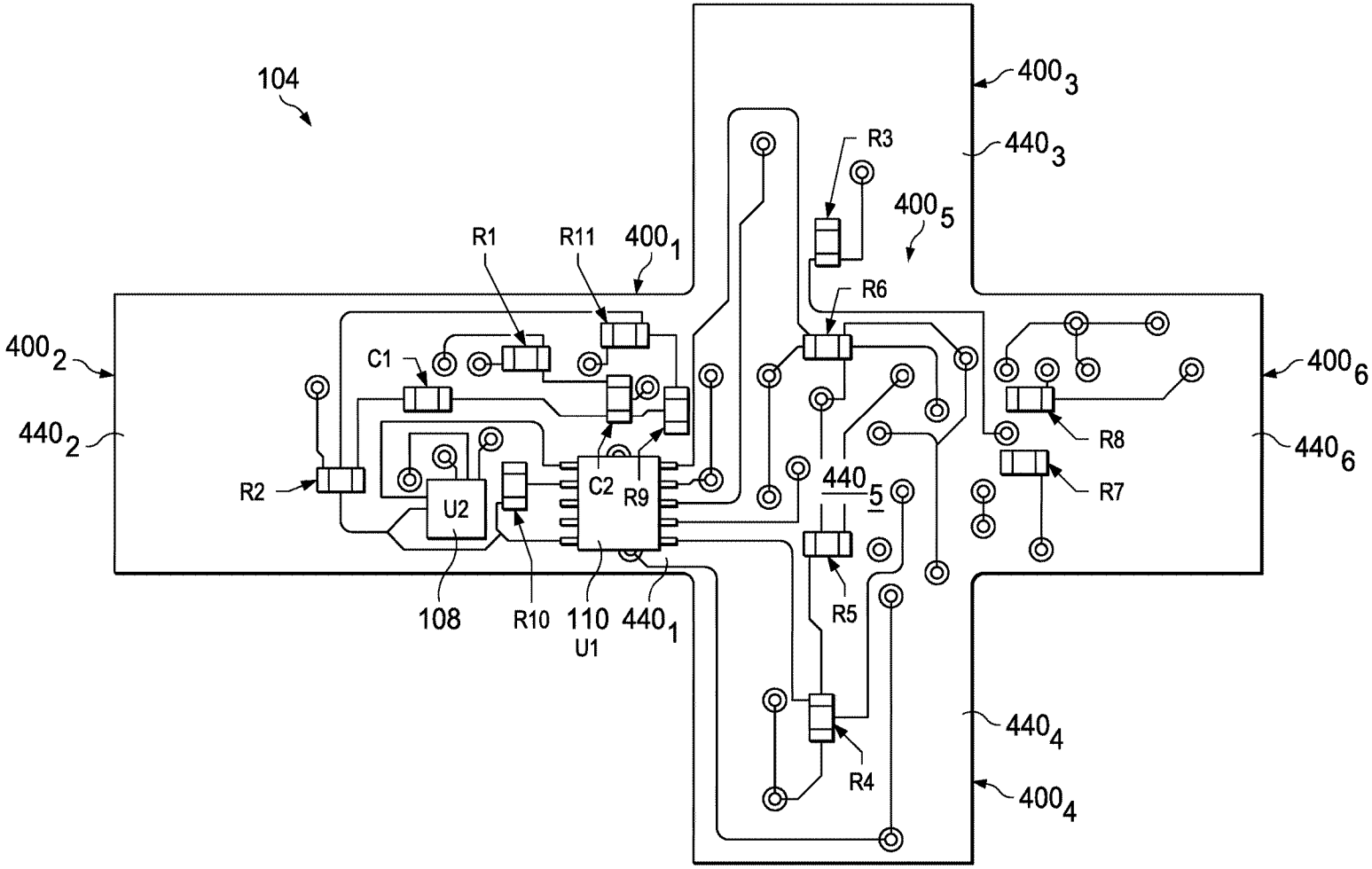

Referring now to FIGS. 9A and 9B, images showing the outer faces ($\mathbf{420}_1$ to $\mathbf{420}_N$) and inner faces ($\mathbf{440}_1$ to $\mathbf{440}_N$), respectively, of a flexible substrate 104 for an electronic gaming die 100 in accordance with another embodiment of the present invention are shown. Like FIGS. 4A and 4B, this embodiment has components on both the outer faces 400 and the inner faces 420 of the flexible substrate 104. This embodiment does, not however, show the battery leads 402 or interface 118 (e.g., mini USB-A, mini USB-b, micro USB-A, micro USB-b, etc.).

Each side 400 of the flexible substrate 104 is assigned an integer from 1 to N (e.g., $\mathbf{400}_1$ to $\mathbf{400}_6$). A number of light emitting diodes 106 are disposed on the outer face 420 of each side 400 of the flexible substrate 104. The number of light emitting diodes 106 equals the integer assigned to the side 400 of the flexible substrate 104 and the corresponding side of the enclosure 102. For example and as shown in FIG. 9A, the first outer face $\mathbf{420}_1$ of the first side $\mathbf{400}_1$ of the flexible substrate 104 has one light emitting diode D1, the second outer face $\mathbf{420}_2$ of the second side $\mathbf{400}_2$ of the flexible substrate 104 has two light emitting diodes D2-D3, the third outer face $\mathbf{420}_3$ of the third side $\mathbf{400}_3$ of the flexible substrate 104 has three light emitting diodes D4-D6, the fourth outer face $\mathbf{420}_4$ of the fourth side $\mathbf{400}_4$ of the flexible substrate 104 has four light emitting diodes D7-D10, the fifth outer face $\mathbf{420}_5$ of the fifth side $\mathbf{400}_5$ of the flexible substrate 104 has five light emitting diodes D11-D15, and the sixth outer face $\mathbf{420}_6$ of the sixth side $\mathbf{400}_6$ of the flexible substrate 104 has six light emitting diodes D16-D21. Each light emitting diode D1-D21 represents a pip of the electronic gaming die 100. Alternatively, the number of light emitting diodes 106 can be greater than the number of the integer assigned to the side 400 of the flexible substrate 104 such that the number of light emitting diodes 106 are arranged to display a numeric character corresponding to the integer.

As shown in FIG. 9B, the sensor 108 and processor 110 are disposed on one of the inner faces (e.g., $\mathbf{440}_1$) of the flexible substrate 104. As will be appreciated by those skilled in the art, the circuit includes various capacitors Cx, resistors Rx, electrical traces (conductors) and other desired components. In addition, one or more inner faces 420 or one or more outer faces 440 of the flexible substrate 104 can be coated with an ultraviolet photocurable polymer to further protect the various components and the flexible substrate 104.

The flexible substrate 104 can be fabricated using traditional flexible circuit board methodologies or fabricated using 3D printing process wherein the electrical conductors that connect the various components are printed conductive traces that can traverse one or more folds of the flexible substrate 104. An example of such a 3D printing system is described in U.S. patent application Ser. No. 13/343,651, which is incorporated by reference in its entirety. The three-dimensional printing device creates one or more layers of a three-dimensional substrate by depositing a substrate material in a layer-by-layer fashion. The three-dimensional printing device can be a fused deposition modeling machine, a selective laser sintering machine or other suitable device.

Figure 10A:
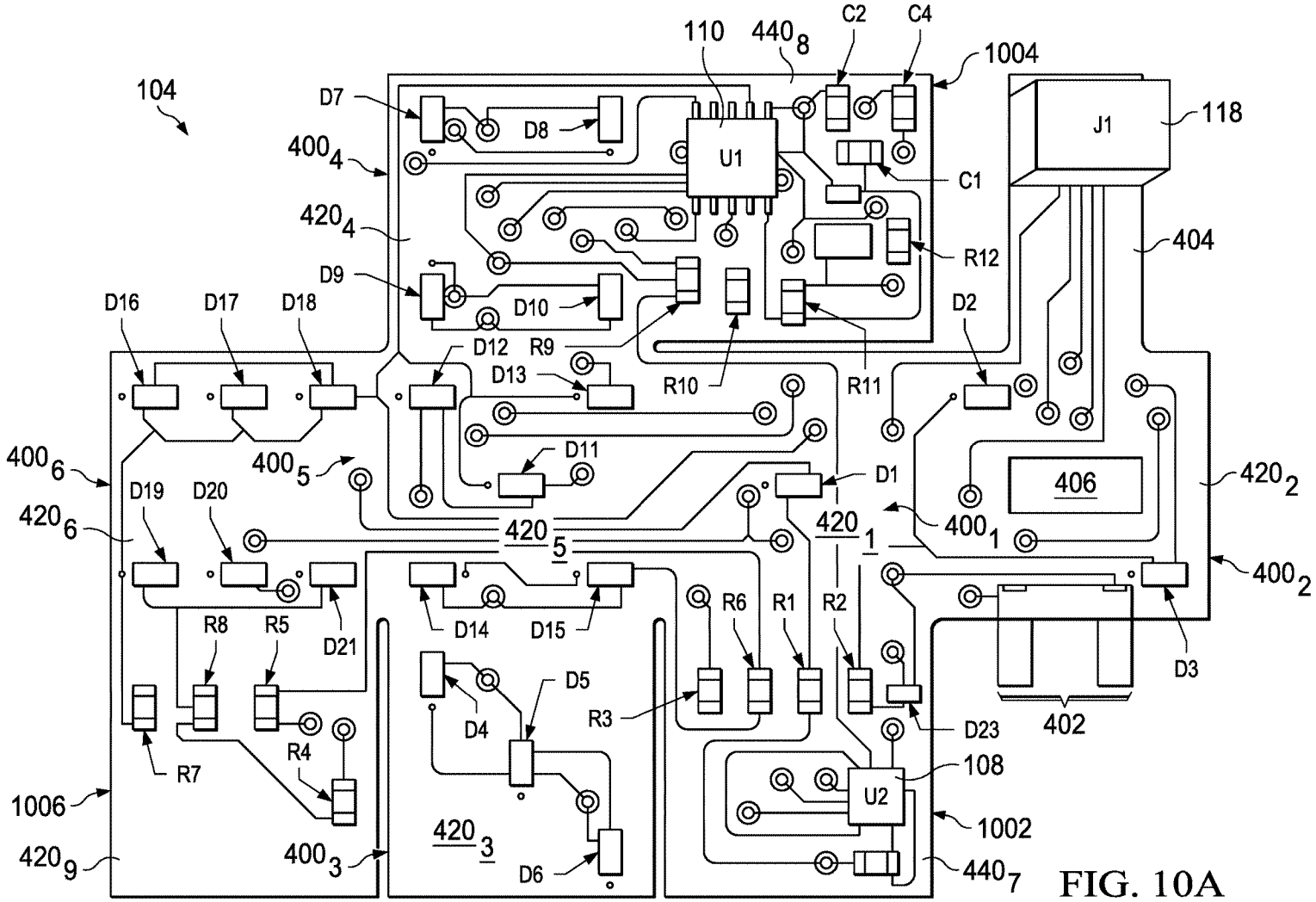
FIGS. 10A and 10B are images showing the outer sides and inner sides, respectively, of a flexible substrate for an electronic gaming die in accordance with yet another embodiment of the present invention.
Figure 10B:
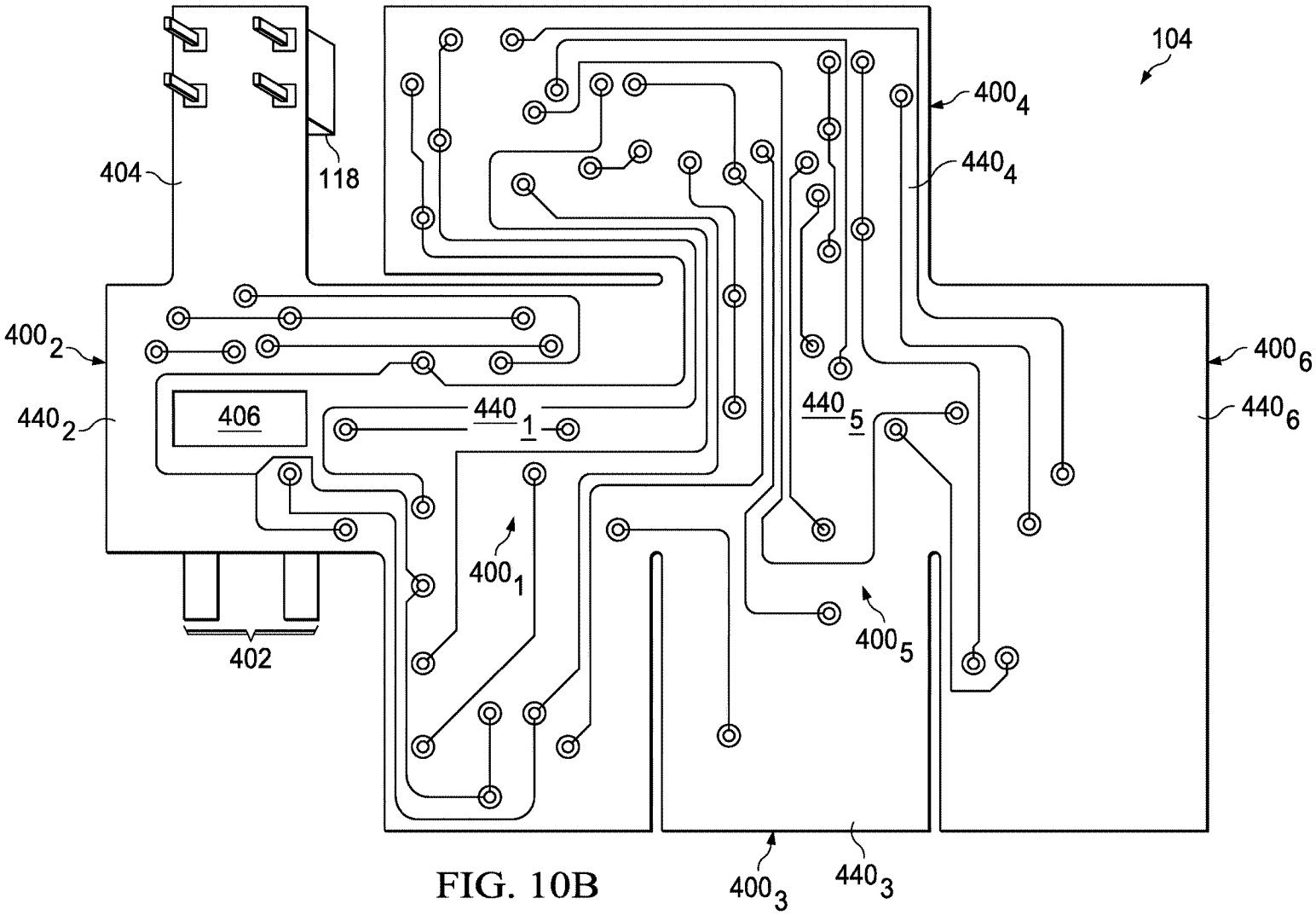

Now referring to FIGS. 10A and 10B, images showing the outer faces ($\mathbf{420}_1$ to $\mathbf{420}_N$) and inner faces ($\mathbf{440}_1$ to $\mathbf{440}_N$), respectively, of a flexible substrate 104 for an electronic gaming die 100 in accordance with yet another embodiment of the present invention are shown. Unlike FIGS. 4A-B and 9A-B, this embodiment has components only on the outer faces 420 of the flexible substrate 104. This embodiment uses three additional squares or sides 1002, 1004 and 1006 to mount the various components on, such that these three sides 1002, 1004 and 1006 are bent towards the back of the completed flexible substrate 104, leaving the components effectively in the back side again. By doing this, the folded flexible substrate inserted into the inside of the cavity 116 of the dice case 102*a* just like the other embodiments. This embodiment greatly reduces the manufacturing price of the flexible substrate 104 (e.g., 40% or more). Some of these savings would be offset by the increased handling of the flexible substrate 104 during manufacture, increased time to build each part and increased risk of damaging it through handling.

Each side 400 of the flexible substrate 104 is assigned an integer from 1 to N (e.g., $\mathbf{400}_1$ to $\mathbf{400}_6$). A number of light emitting diodes 106 are disposed on the outer face 420 of each side 400 of the flexible substrate 104. The number of light emitting diodes 106 equals the integer assigned to the side 400 of the flexible substrate 104 and the corresponding side of the enclosure 102. For example and as shown in FIG. 10A, the first outer face $\mathbf{420}_1$ of the first side $\mathbf{400}_1$ of the flexible substrate 104 has one light emitting diode D1, the second outer face $\mathbf{420}_2$ of the second side $\mathbf{400}_2$ of the flexible substrate 104 has two light emitting diodes D2-D3, the third outer face $\mathbf{420}_3$ of the third side $\mathbf{400}_3$ of the flexible substrate 104 has three light emitting diodes D4-D6, the fourth outer face $\mathbf{420}_4$ of the fourth side $\mathbf{400}_4$ of the flexible substrate 104 has four light emitting diodes D7-D10, the fifth outer face $\mathbf{420}_5$ of the fifth side $\mathbf{400}_5$ of the flexible substrate 104 has five light emitting diodes D11-D15, and the sixth outer face $\mathbf{420}_6$ of the sixth side $\mathbf{400}_6$ of the flexible substrate 104 has six light emitting diodes D16-D21. Each light emitting diode D1-D21 represents a pip of the electronic gaming die 100. Alternatively, the number of light emitting diodes 106 can be greater than the number of the integer assigned to the side 400 of the flexible substrate 104 such that the number of light emitting diodes 106 are arranged to display a numeric character corresponding to the integer.

The sensor 108 is disposed the outer face (e.g., $\mathbf{420}_7$) of one of the added sides 1002. The processor 110 is disposed on outer face (e.g., $\mathbf{420}_8$) of the one of the added sides 1004. Additional components, such as resistors R4, R5, R7 and R8 are disposed on the outer face (e.g., $\mathbf{420}_9$) of one of the added sides 1006. Two leads 402 are used to connect the circuit to the battery 112 (not shown). An additional side 404 is used to mount the interface 118 (e.g., mini USB-A, mini USB-b, micro USB-A, micro USB-b, etc.) and orient the interface 118 to be accessible via the opening 406 in side $\mathbf{400}_2$. As will be appreciated by those skilled in the art, the circuit includes various capacitors Cx, resistors Rx, electrical traces (conductors) and other desired components. In addition, one or more inner faces 420 or one or more outer faces 440 of the flexible substrate 104 can be coated with an ultraviolet photocurable polymer to further protect the various components and the flexible substrate 104.

The flexible substrate 104 can be fabricated using traditional flexible circuit board methodologies or fabricated using 3D printing process wherein the electrical conductors that connect the various components are printed conductive traces that can traverse one or more folds of the flexible substrate 104. An example of such a 3D printing system is described in U.S. patent application Ser. No. 13/343,651, which is incorporated by reference in its entirety. The three-dimensional printing device creates one or more layers of a three-dimensional substrate by depositing a substrate material in a layer-by-layer fashion. The three-dimensional printing device can be a fused deposition modeling machine, a selective laser sintering machine or other suitable device.

Figure 11:
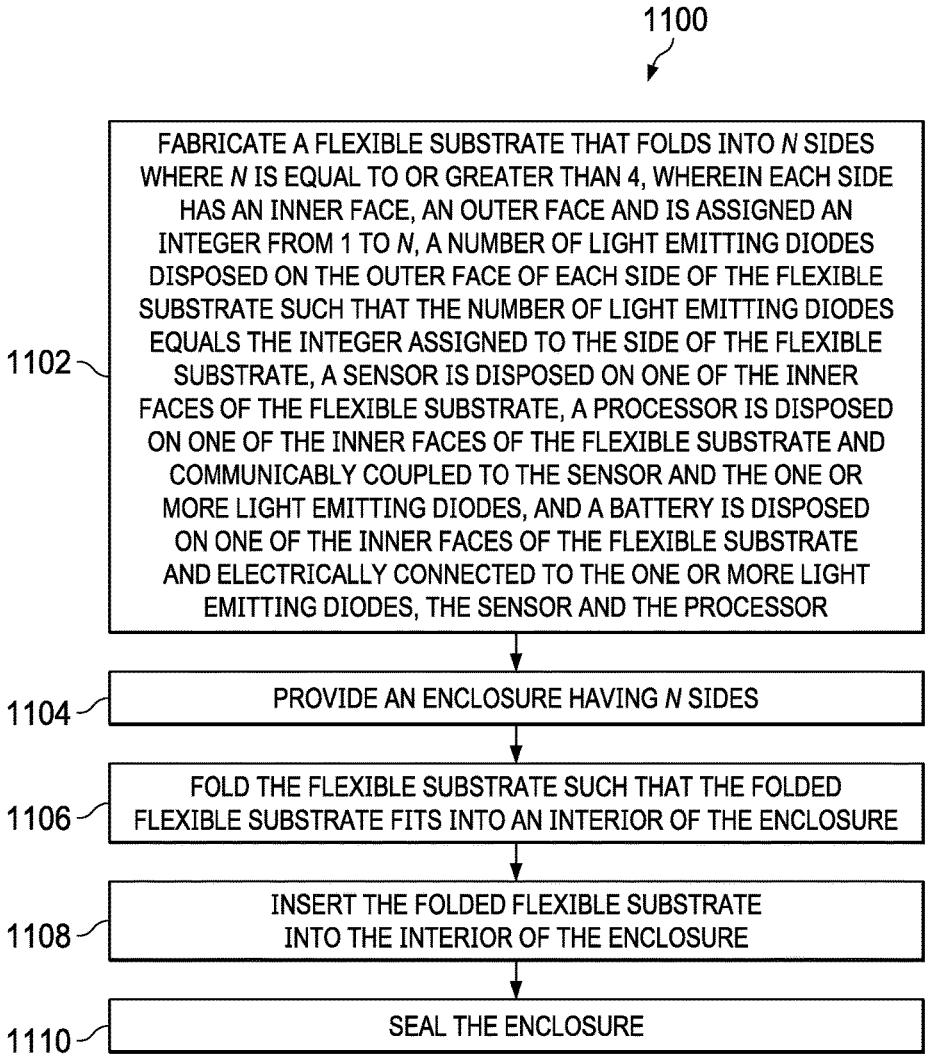
FIG. 11 is a flow chart of a method for manufacturing an electronic gaming die in accordance with one embodiment of the present invention.

Now referring to FIG. 11, a flow chart of operations of a method 1100 for manufacturing an electronic gaming die 100 in accordance with an example embodiment is shown. A flexible substrate can be fabricated as indicated at block 1102. The flexible substrate folds into N sides where N is equal to or greater than 4, wherein each side has an inner face, an outer face and is assigned an integer from 1 to N (e.g., equals 4, 6, 8, 10, 20, etc.). A number of light emitting diodes disposed on the outer face of each side of the flexible substrate such that the number of light emitting diodes equals the integer assigned to the side of the flexible substrate. A sensor is disposed on one of the inner faces of the flexible substrate. A processor is disposed on one of the inner faces of the flexible substrate and communicably coupled to the sensor and the one or more light emitting diodes. A battery is disposed on one of the inner faces of the flexible substrate and electrically connected to the one or more light emitting diodes, the sensor and the processor. An enclosure having N sides can be provided as shown at block 1104. The flexible substrate can be folded as depicted at block 1106 such that the folded flexible substrate fits into an interior of the enclosure. The folded flexible substrate is inserted into the interior of the enclosure as indicated at block 1108 and the enclosure is sealed as shown at block 1110. As previously described, the shape of the folded flexible substrate can be maintained by: placing an insert within an interior of the folded flexible substrate; attaching one or more edges of the sides of the flexible substrate together using an adhesive or one or more connectors; or depositing an expanding foam sealant within an interior of the folded flexible substrate. In addition, one or more inner faces or one or more outer faces of the flexible substrate can be coated with an ultraviolet photocurable polymer to further protect the various components and the flexible substrate. Moreover, this method can be implemented as a computer program embodied on a non-transitory computer readable medium wherein the steps are preformed using one or more code segments.

As previously mentioned, the flexible substrate can be fabricated using a conductive ink micro-dispensing process wherein the electrical conductors that connect the various components are printed conductive traces that can traverse one or more folds of the flexible substrate 104. An example of such a 3D printing system is described in U.S. patent application Ser. No. 13/343,651, which is incorporated by reference in its entirety. The three-dimensional printing device creates one or more layers of a three-dimensional substrate by depositing a substrate material in a layer-by-layer fashion. The three-dimensional printing device can be a fused deposition modeling machine, a selective laser sintering machine or other suitable device. Other machines may include a micro-machining machine, a CNC micro-machining machine, a micro electrical discharge machining machine, an electrochemical machining machine, a direct write proton micro-machining machine, a laser ablation machine, a radiative source, an ultrasonic cutting machine, a hot wire cutting machine, a waterjet machine, an etching machine, a deep reactive ion etching machine, a plasma etching machine, a crystal orientation dependent etching machine, a wet bulk micromachining machine, a UV-lithography or X-ray lithography (LIGA) machine, a hot embossing lithography machine, a precision mechanical sawing machine, a chemically assisted ion milling machine, a sand blasting machine or a cutting machine. A component placement machine can be used to place and assemble the various components. In addition, the system may include a slide, a conveyor or a robotic device that transports the components and electronic gaming die to each machine. Note that all of the machines can be integrated into a single machine.

Figure 12:
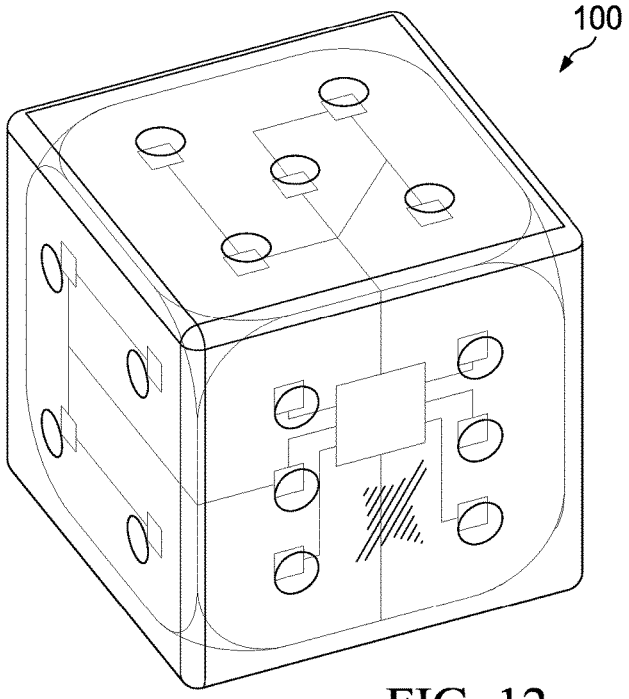
FIG. 12 is an image of an electronic gaming die in accordance with another embodiment of the present invention.
Figure 13:
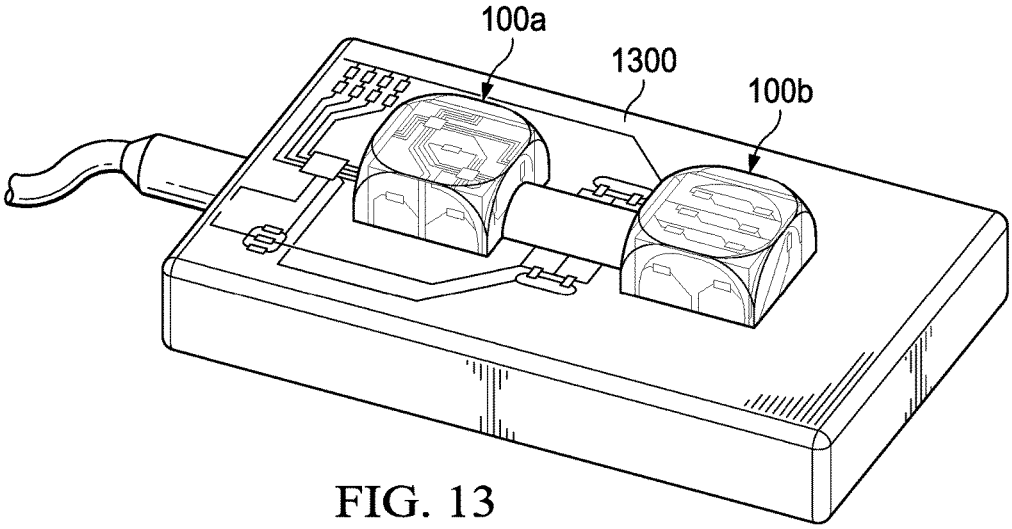
FIG. 13 is an image of a wireless battery charging device with two electronic gaming dice in accordance with another embodiment of the present invention.

The substrate material can be a thermoplastic material, another polymer material, a ceramic material, a metallic material, a mineral material, a glass ceramic material, a semi-conductor material, a nanomaterial, a biomaterial, an organic material, an inorganic material or any combination thereof. The thermoplastic material can be acrylonitrile butadiene styrene (ABS), ABSi, ABSplus, ABS-M30, ABS-M30i, polycarbonate (PC), PC-ABS, PC-ISO, polyphenylsulfone (PPSF/PPSU), ULTEM 9085 or any combination thereof. The another polymer material can be poly(methyl methacrylate) (PMMA), polypropylene, polyolefin, LL-PE, HDPE, polyvinyl acetate, polyester, polyamides, nylon, polyimides, polyketone, polyether ethyl ketone (PEEK), polybutadiene, polylactic acid, polycaprolactone, polyethylene terephthalate, liquid crystalline polymer (LCP), polystyrene, polyvinyl chloride, polyfluoroethylene, polydifluoroethylene, polytetrafluoroethylene, ZEONEX RS420, Eccostock HIK-TPO, co-polymers and block co-polymers of the previous, or any combination thereof FIG. 12 illustrates an image of an electronic gaming die 100 in accordance with another example embodiment. FIG. 13 illustrates an image of a wireless battery charging device 1300 with two electronic gaming dice 100*a* and 100*b* in accordance with another example embodiment.

It may be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

All publications, patents and patent applications mentioned in the specification are indicative of the level of skill of those skilled in the art to which this invention pertains. All publications, patents and patent applications are herein incorporated by reference to the same extent as if each individual publication, patent or patent application was specifically and individually indicated to be incorporated by reference.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context.

All of the compositions and/or methods disclosed and claimed herein can be made and executed without undue experimentation in light of the present disclosure. While the compositions and methods of this invention have been described in terms of preferred and alternative embodiments, it may be apparent to those of skill in the art that variations may be applied to the compositions and/or methods and in the steps or in the sequence of steps of the method described herein without departing from the concept, spirit and scope of the disclosed embodiments. All such similar substitutes and modifications apparent to those skilled in the art are deemed to be within the spirit, scope and concept of the disclosed embodiments as defined by the appended claims.

What is claimed is:

1. An electronic gaming die comprising:

an enclosure having N sides where N is equal to or greater than 4;

a flexible substrate that folds into N sides and fits into an interior of the enclosure, wherein each side has an inner face, an outer face and is assigned an integer from 1 to N, said flexible substrate comprising a folded flexible substrate;

a number of light emitting diodes disposed on the outer face of each side of the flexible substrate, wherein the number of light emitting diodes equals the integer assigned to the side of the flexible substrate;

a sensor disposed on one of the inner faces of the flexible substrate;

an expanding foam sealant disposed within an interior of the folder flexible substrate;

a processor disposed on one of the inner faces of the flexible substrate and communicably coupled to the sensor and the one or more light emitting diodes; and a battery disposed on one of the inner faces of the flexible substrate and electrically connected to the one or more light emitting diodes, the sensor and the processor.

2. The electronic gaming die as recited in claim 1, wherein the sensor, the processor and the battery are disposed on an outer face of one or more additional sides of the flexible substrate that fold inside the N sides.

3. The electronic gaming die as recited in claim 1, further comprising an insert disposed within an interior of the folded flexible substrate and sized to maintain a position of the flexible substrate against the interior of the enclosure.

4. The electronic gaming die as recited in claim 3, wherein the insert is rigid, semi-rigid, hollow.

5. The electronic gaming die as recited in claim 1 further comprising an adhesive or one or more connectors that attach one or more edges of the sides of the flexible substrate together to maintain a shape of the folded flexible substrate.

6. The electronic gaming die as recited in claim 1, wherein N equals 4, 6, 8, 10 or 20.

7. The electronic gaming die as recited in claim 1, wherein each light emitting diode represents a pip of the electronic gaming die.

8. The electronic gaming die as recited in claim 1, wherein the number of light emitting diodes are greater than the number of the integer assigned to the side of the flexible substrate such that the number of light emitting diodes are arranged to display a numeric character corresponding to the integer.

9. The electronic gaming die as recited m claim 1, wherein the enclosure is transparent or semi-transparent.

10. The electronic gaming die as recited in claim 1, wherein a portion of the enclosure proximate to the one or more light emitting diodes is transparent or semi-transparent, and the remainder of the enclosure is opaque.

11. The electronic gaming die as recited in claim 1, further comprising one or more inscriptions engraved on the enclosure.

12. The electronic gaming die as recited in claim 1, wherein the sensor comprises a three-axis accelerometer.

13. The electronic gaming die as recited in claim 1, wherein the insert is weighted to balance a weight of the die.

14. The electronic gaming die as recited in claim 1, wherein the insert is weighted to unbalance the die to favor a specified orientation.

15. The electronic gaming die as recited in claim 1, wherein the light emitting diodes stay lit for a specified period of time.

16. The electronic gaming die as recited in claim 1, wherein the light emitting diodes flash to show which side of the enclosure is up when the electronic gaming die stops rolling.

17. The electronic gaming die as recited in claim 1, wherein the electronic gaming die enters a sleep mode whenever one or more sleep conditions occur.

18. The electronic gaming die as recited in claim 17, wherein the electronic gaming die remains in the sleep mode until one or more wakeup conditions occur.

19. The electronic gaming die as recited in claim 1, wherein the battery is replaceable or rechargeable.

20. The electronic gaming die as recited in claim 1, further comprising an interface electrically connected to the battery and accessible from an exterior of the enclosure to recharge the battery.

21. The electronic gaming die as recited in claim 20, whereas the interface which is accessible from an exterior of the enclosure is electrically connected to the processor and allows for external programming to establish its performance and allows for subsequent reprogramming to modify its performance.

22. The electronic gaming die as recited in claim 20, wherein the interface comprises a port of the USB family: mini USB-A, mini USB-b, micro USB-A, micro USB-b.

23. The electronic gaming die as recited in claim 1, further comprising a wireless battery recharging circuit electrically connected to the battery and disposed on one of the inner faces of the flexible substrate.

24. The electronic gaming die as recited in claim 1, further comprising one or more photovoltaic cells electrically connected to the battery and disposed on or within the enclosure or the flexible substrate.

25. The electronic gaming die as recited in claim 1, wherein the processor and sensor detect a roll, measure a direction of gravity and illuminate the light emitting diode(s) on the upward face.

26. The electronic gaming die as recited in claim 1, further comprising a plurality of electrical conductors that traverse one or more folds of the flexible substrate.

27. The electronic gaming die as recited in claim 26, wherein the plurality of electrical conductors comprise a plurality of printed conductive traces.

28. The electronic gaming die as recited in claim 1, further comprising an ultraviolet photocurable polymer coating disposed on one or more inner faces or one or more outer faces of the flexible substrate.

29. The electronic gaming die as recited in claim 1, wherein the flexible substrate is fabricated using a conductive ink micro-dispensing process.

30. A method for manufacturing an electronic gaming die comprising the steps of:

fabricating a flexible substrate that folds into N sides where N is equal to or greater than 4, wherein each side has an inner face, an outer face and is assigned an integer from 1 to N, a number of light emitting diodes disposed on the outer face of each side of the flexible substrate such that the number of light emitting diodes equals the integer assigned to the side of the flexible substrate, a sensor is disposed on one of the inner faces of the flexible substrate, a processor is disposed on one of the inner faces of the flexible substrate and communicably coupled to the sensor and the one or more light emitting diodes, and a battery is disposed on one of the inner faces of the flexible substrate and electrically connected to the one or more light emitting diodes, the sensor and the processor;

coating one or more inner faces or one or more outer faces of the flexible substrate with an ultraviolet photocurable polymer;

providing an enclosure having N sides;

folding the flexible substrate such that the folded flexible substrate fits into an interior of the enclosure;

inserting the folded flexible substrate into the interior of the enclosure; and sealing the enclosure.

31. The method as recited in claim 30, wherein the sensor, the processor and the battery are disposed on an outer face of one or more additional sides of the flexible substrate that fold inside the N sides.

32. The method as recited In claim 30, further comprising the step of placing an insert within an interior of the folded flexible substrate, wherein the insert is sized to maintain a position of the flexible substrate against the interior of the enclosure.

33. The method as recited in claim 32, wherein the insert is rigid, semi-rigid, or hollow.

34. The method as recited in claim 30, further comprising the step of attaching one or more edges of the sides of the flexible substrate together to maintain a shape of the folded flexible substrate using an adhesive or one or more connectors.

35. The method as recited in claim 30, further comprising the step of depositing an expanding foam sealant within an interior of the folded flexible substrate.

36. The method as recited in claim 30, wherein N equals 4, 6, 8, 10 or 20.

37. The method as recited in claim 30, wherein each light emitting diode represents a pip of the electronic gaming die.

38. The method as recited in claim 30, wherein the number of light emitting diodes are greater than the number of the integer assigned to the side of the flexible substrate such that the number of light emitting diodes are arranged to display a numeric character corresponding to the integer.

39. The method as recited in claim 30, wherein the enclosure is transparent or semi-transparent.

40. The method as recited in claim 30, wherein a portion of the enclosure proximate to the one or more light emitting diodes is transparent or semi-transparent, and the remainder of the enclosure is opaque.

41. The method as recited in claim 30, further comprising the step of engraving one or more inscriptions on the enclosure.

42. The method as recited in claim 30, wherein the sensor comprises a three-axis accelerometer.

43. The method as recited in claim 30, wherein the insert is weighted to balance a weight of the die.

44. The method as recited in claim 30, wherein the insert is weighted to unbalance the die to favor a specified orientation.

45. The method as recited in claim 30, wherein the light emitting diodes stay lit for a specified period of time.

46. The method as recited in claim 30, wherein the light emitting diodes flash to show which side of the enclosure is up when the electronic gaming die stops rolling.

47. The method as recited in claim 30, further comprising the step of entering a sleep mode whenever one or more sleep conditions occur.

48. The method as recited in claim 47, further comprising the step of remaining in the sleep mode until one or more wakeup conditions occur.

49. The method as recited in claim 30, wherein the battery is replaceable or rechargeable.

50. The method as recited in claim 30, further comprising an interface electrically connected to the battery and accessible from an exterior of the enclosure to recharge the battery.

51. The method as recited in claim 50, wherein the interface comprises a port of the mini or micro USB family.

52. The method as recited in claim 30, further comprising a wireless battery recharging circuit electrically connected to the battery and disposed on one of the inner faces of the flexible substrate.

53. The method as recited in claim 30, further comprising one or more photovoltaic cells electrically connected to the battery and disposed on or within the enclosure or the flexible substrate.

54. The method as recited in claim 30, wherein the processor and sensor detect a roll, measure a direction of gravity and illuminate the light emitting diode(s) on the upward face.

55. The method as recited in claim 30, further comprising a plurality of electrical conductors that traverse one or more folds of the flexible substrate.

56. The method as recited in claim 30, wherein the plurality of electrical conductors comprise a plurality of printed conductive traces.

57. The method as recited in claim 30, wherein the flexible substrate is fabricated using a conductive ink microdispensing process.

* * * * *